US007543799B2

(12) United States Patent
Willis et al.

(10) Patent No.: US 7,543,799 B2
(45) Date of Patent: Jun. 9, 2009

(54) METHOD AND APPARATUS FOR DEPLOYING ARTICLES IN DEEP WATERS

(75) Inventors: Stewart K. Willis, Aboyne (GB); Graham Mann, Strachan (GB)

(73) Assignee: Acergy UK Limited, Bucksburn, Aberdeen (GB)

( * ) Notice: Subject to any disclaimer, the term of this patent is extended or adjusted under 35 U.S.C. 154(b) by 555 days.

(21) Appl. No.: 10/503,337

(22) PCT Filed: Jan. 23, 2003

(86) PCT No.: PCT/GB03/00286

§ 371 (c)(1), (2), (4) Date: Mar. 8, 2005

(87) PCT Pub. No.: WO03/062042

PCT Pub. Date: Jul. 31, 2003

(65) Prior Publication Data

US 2005/0191165 A1 Sep. 1, 2005

(30) Foreign Application Priority Data

Jan. 24, 2002 (GB) ..... 0201540.2
Mar. 6, 2002 (GB) ..... 0205251.2

(51) Int. Cl.
*B66D 1/36* (2006.01)

(52) U.S. Cl. ..... 254/336; 254/393

(58) Field of Classification Search ..... 254/334–336, 254/278, 393; 24/136 K; 403/57, 58, 79
See application file for complete search history.

(56) References Cited

U.S. PATENT DOCUMENTS 424,388 A * 3/1890 Weigel ..... 403/211
1,380,800 A * 6/1921 Haworth ..... 403/211
3,785,511 A * 1/1974 Bonnamy et al. ..... 414/139.7
4,384,389 A * 5/1983 Sato ..... 24/136 K
4,552,339 A * 11/1985 Werners et al. ..... 254/277
4,632,622 A * 12/1986 Robinson ..... 414/139.6
4,813,172 A * 3/1989 McCue ..... 43/43.12
5,018,775 A * 5/1991 McKenna et al. ..... 294/74

(Continued)

FOREIGN PATENT DOCUMENTS

DE 674 189 3/1939

(Continued)

OTHER PUBLICATIONS

Peters; "Linear chain tensioning of moored production vessels"; *World Oil*; No. 6, Jun. 1993; pp. 107-108; 110-112.

*Primary Examiner*—Emmanuel M Marcelo
(74) *Attorney, Agent, or Firm*—Sheridan Ross P.C.

(57) ABSTRACT

Equipment and method for lowering equipment (10) to the seabed from a vessel (12) using man made fibre rope (16) and a winch (20) employing wire rope (24), the fibre rope being paid out (or when lifting, drawn in) in sections by repeated operation of the winch (20) and wire rope (24). This is preferably done by holding the fibre rope (16) with holding means (32), while the wire rope (24) is detached for connection to a next section. The holding means (32) may be arranged to engage an attachment point (18) between adjacent rope sections but distinct from that engaged by the hoist platform (22).

24 Claims, 9 Drawing Sheets

U.S. PATENT DOCUMENTS

| | | | | |
|---|---|---|---|---|
| 5,028,194 | A * | 7/1991 | Robinson | 414/139.6 |
| 5,044,826 | A * | 9/1991 | Forster | 405/169 |
| 6,712,336 | B1 * | 3/2004 | Crawford | 254/266 |
| 6,752,100 | B2 * | 6/2004 | Guinn et al. | 114/258 |
| 7,007,623 | B2 * | 3/2006 | Boatman et al. | 114/230.15 |

FOREIGN PATENT DOCUMENTS

| | | | |
|---|---|---|---|
| DE | 696 736 | | 8/1940 |
| GB | 1457711 | | 12/1976 |
| GB | 1484410 | | 9/1977 |
| GB | 2132158 | | 7/1984 |
| GB | 2162315 | | 1/1986 |
| GB | 2178718 | | 2/1987 |
| JP | 61215191 | A | 9/1986 |

* cited by examiner

METHOD AND APPARATUS FOR DEPLOYING ARTICLES IN DEEP WATERS

The invention relates to methods and apparatuses for deploying articles to great depth beneath the sea surface, for example to the seabed in deep waters.

Cranes and winches employing wire rope have been used to deploy loads to the seabed in modest water depth for many years. Some of these cranes and winch systems are fitted with, or used in conjunction with, heave compensators, which take-up and pay out the rope dynamically, to compensate vertical motion (heave) of the ship, barge or other platform from which the rope is supported.

As water depth increases, the weight of wire needed to lower equipment to the seabed increases until it becomes such a significant part of the total load that the method becomes impractical. Man made fibre rope can be almost neutrally buoyant and have strength and elastic characteristics similar to wire rope and is therefore potentially a suitable replacement for wire. Man made fibre rope, however, has a poor tolerance to the fatigue induced by bend cycling under load, and is thus unsuitable for use with current designs of heave compensator or with heave compensated drum winches. The same problem exists for winch systems without heave compensation, although the bend cycling will typically be less severe than in heave-compensated systems. Alternative systems can also be envisaged which do not increase bend cycling for the purpose of heave compensation, but bend cycling for the basic lifting/lowering operation is harder to avoid.

The invention aims to obtain the weight benefits of using fibre rope, while avoiding the need for bend cycling fibre rope under load, when deploying loads from a vessel at sea.

Broadly stated the invention provides equipment and method for lowering equipment to the seabed from a vessel using man made fibre rope and a winch employing wire rope, the fibre rope being paid out (or when lifting, drawn in) in sections by repeated operation of the winch and wire rope.

The fibre rope may be continuous and provided with eyes, stoppers or other attachment points at regular intervals.

The fibre rope may alternatively comprise discrete sections terminated with eyes or other attachment points, connected together to form the required length. In this case, the connections between sections may be made (or un-made) in the course of paying out (drawing in), or the entire length may be connected in advance and reeled during operation.

Each fibre rope section may be terminated by looping around a thimble comprising a body with a peripheral channel for the rope, and two distinct openings, one opening receiving a connection (directly or indirectly) to the next rope sections, the other receiving a connection (directly or indirectly) to the hoist mechanism. In a particular embodiment disclosed in detail below, the second opening receives a bolt which fixes a stopper to the thimble, the stopper being temporarily engaged by the hoist mechanism.

The stopper comprises a part-conical member formed in two halves held together by the bolt. In other arrangements, it can be envisaged that the hoist mechanism engages the thimble directly.

The thimble having two distinct apertures and optionally a stopper permanently attachable thereto is also an independent aspect of the invention, for which novelty is claimed.

The fibre rope may be provided between adjacent rope sections with stoppers engaged and released by a hoist mechanism openable by remote control to engage and release the fibre rope.

In a preferred embodiment, the wire rope is arranged to raise and lower a hoist mechanism, the hoist mechanism being operable by remote control to allow the mechanism to pass freely up and down the rope, and then to engage the rope by means of said stopper.

The fibre rope may be held at a holding means, while the wire rope is detached for connection to a next section. The holding means may be arranged to engage an attachment point between adjacent rope sections but distinct from that engaged by the hoist platform. A pair of collars or other stoppers is sufficient, spaced longitudinally to allow sufficient clearance between hoist mechanism and the holding means.

Preferably the wire rope winch is heave compensated, permitting operation in a wider range of sea states and reducing strain on the components of the apparatus.

The wire rope winch and holding means may both be heave-compensated, such that heave compensation can be maintained throughout the process of transferring the load from one to the other. The holding means and wire rope winch may be heave compensated in parallel by a common heave compensator, for example comprising a hydraulic ram.

The winch and wire rope may be arranged in a double fall arrangement, with the end of the wire rope fixed on board the vessel while a running block is lowered and raised, alternately connected to and disconnected from the fibre rope.

The invention further provides an apparatus comprising a rope store, hoist means and holding means adapted for deployment from a sea-going vessel for implementing a method of raising or lowering according to the invention as set forth above.

The invention further provides a fibre rope assembly comprising plural rope sections and load-bearing stoppers connected between the sections, the rope assembly being adapted for use with a method according to the invention as set forth above.

BRIEF DESCRIPTION OF THE DRAWINGS

Embodiments of the invention will now be described, by way of example only, with reference to the accompanying drawings, in which.

DETAILED DESCRIPTION OF EXEMPLARY EMBODIMENTS

General Arrangement

Figure 1:
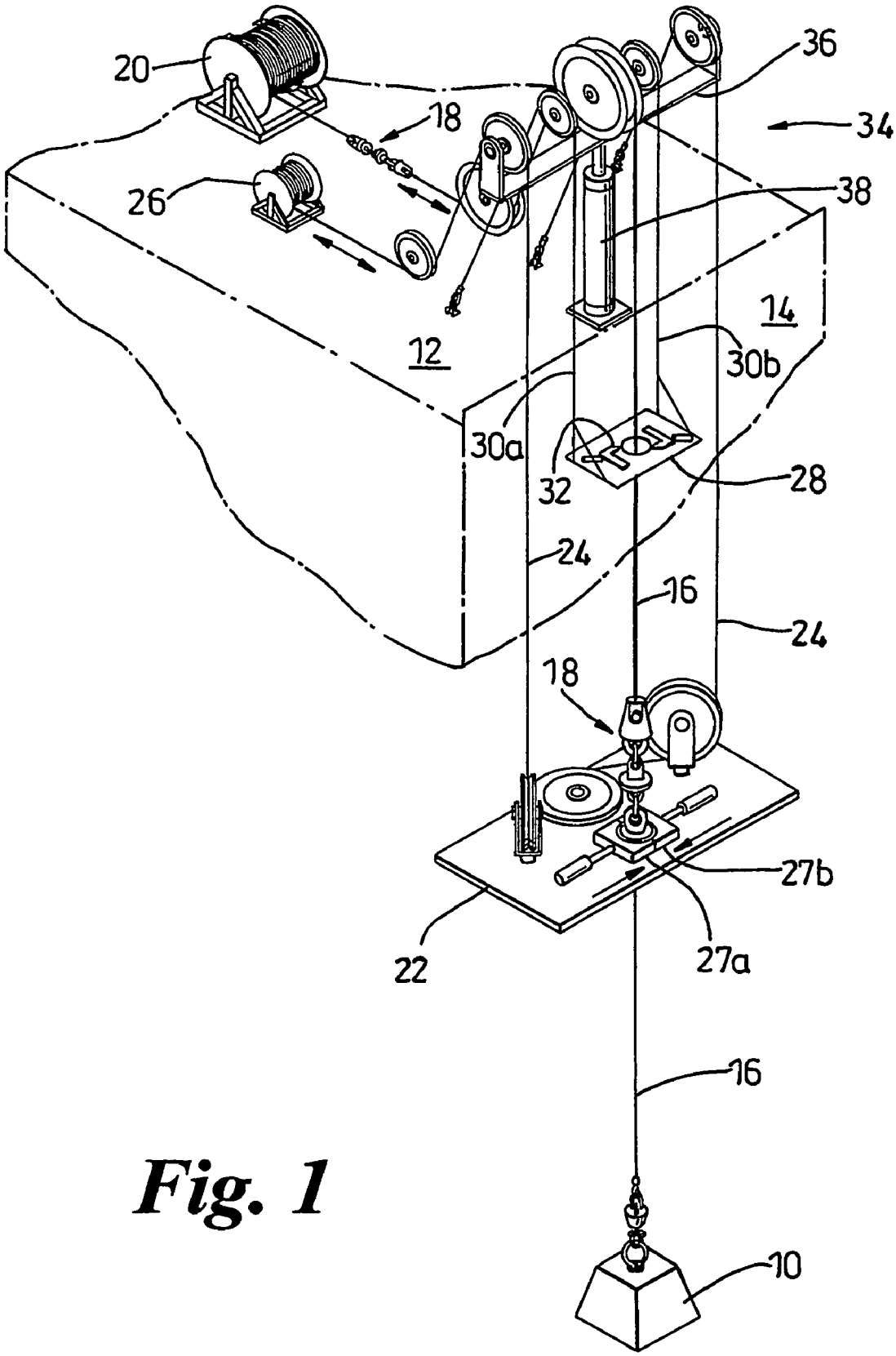
FIG. 1 shows the general arrangement of a lifting apparatus according to one embodiment of the present invention.

FIG. 1 shows the general arrangement of a heave compensated lifting apparatus lowering a load 10 over the side of a vessel (not shown in full) in deep water. The load in this case is shown as a simple clump weight, but of course could be any module or tool which requires to be deployed to a great depth beneath the sea surface. Depths well in excess of 1000 m are routinely encountered in offshore developments, although the invention is not limited to any particular range of depth. A portion of the deck of the vessel is indicated schematically at 12, while the side wall of the vessel is indicated at 14. This could equally be the side wall of a moonpool, depending for example on the size of the load to be deployed.

Load 10 is suspended chiefly on a man-made fibre rope 16, made in segments with joints 18 along its length. A drum winch 20 mounted on deck 12 stores sufficient rope 16 for the depth of operation. The length of each segment may be 50 m, 100 m, or 300 m for example.

A hoist platform 22 is suspended over the side of the vessel by a double-drop steel wire 24 a hoist winch 26 provided on deck 12 stores the wire 24. Rope 16 passes through hoist jaws 28 mounted on hoist platform 22, and engages part of a joint 18, such that the weight of the load 10 is carried by hoist platform 22 and will stop the tension caused by the weight of the load is thus not experienced by portions of rope 16 above the level of platform 22.

A hang-off platform 28 is also suspended by wires 30*a* and 30*b* hang-off platform 28 carries a latch 32 which can be opened and closed to engage another portion of the joint 18 in rope 16, which passes through an aperture in hang-off platform 28. Hang-off platform 28 acts as a holding means and is arranged to stay at a relatively fixed height in relation to this sea surface, while hoist platform 22, by operation of hoist system winch 26, travels from a level just below hang-off platform 28 to a depth at least corresponding to the length of one segment in fibre rope 16.

Finally in this embodiment, FIG. 1 shows a heave compensator 34, comprising a number of sheaves (pulley wheels) mounted on a cross head 36 which is connected to the deck by a hydraulic ram 38. Rope 16 and wires 24 and 30 all pass over respective sheaves mounted on cross head 36. In operation, ram 38 is controlled automatically in response to heave (vertical motion) of the vessel, so as to isolate high-off platform 28 and hoist platform 22, and hence load 10, from this vertical motion. The principles of heave compensation are well-known, and appropriate systems are available from a number of manufacturers. The detail of the heave compensation system will not be described further. Moreover, it will be appreciated that heave compensator 34 can be omitted if it is not necessary in a given application.

The arrangement shown in FIG. 1 can be adapted to function without heave compensation, simply by eliminating ram 38 and envisaging the sheaves carried by cross head 36 being mounted at a fixed height above deck 12.

The various components of the lifting apparatus shown in FIG. 1 will be described in more detail below. It should be appreciated that the detailed arrangement is only one possible example.

Hoist System

FIG. 12 shows in more detail the hoist system platform and the manner in which it is suspended by wire 24. Heave compensator 34 is shown in broken outline, to avoid obscuring relevant detail. In this drawing, platform 22 is shown as a simple steel plate, which may of course be reinforced according to its load-bearing function. Aperture 40 can been seen, through which rope 16 and joint 18 can pass freely (the aperture is shown smaller than life in the figure to improve its visibility). Jaws 27*a* and *b* are provided each with half-conical bearing surfaces 42*a* and 42*b* for engaging part of a joint 18 in rope 16. The detailed form of the joints in the rope will be described below in relation to FIG. 4. Jaws 27*a* and 27*b* are open and closed by means of hydraulic rams 44*a* and 44*b*. An inset detail 46 shows the jaws in the closed position and engaging a joint 18 of rope 16.

As mentioned already, hoist platform 22 is supported in operation by wire rope 24. Three sheaves 48, 50 and 52 are provided on hoist platform 22, for guiding the wire 24 from two points of suspension at either end of the platform around the area of the aperture 40. By this arrangement, vertical load on the jaws 27*a*, 27*b* acts substantially on the line between the two portions of wire 24.

Also associated with the hoist system platform and wire rope 24 are hoist winch 20 already mentioned, a strong point 53 on deck 12, first and second sheaves 54 and 56 mounted on the heave compensator cross head 36 and a fixed sheave 58 mounted on the deck. The mounting and bearings of these sheaves are omitted for clarity. The functioning of the hoist will be described later.

Holding Means/Hang-off Platform

Figure 3:
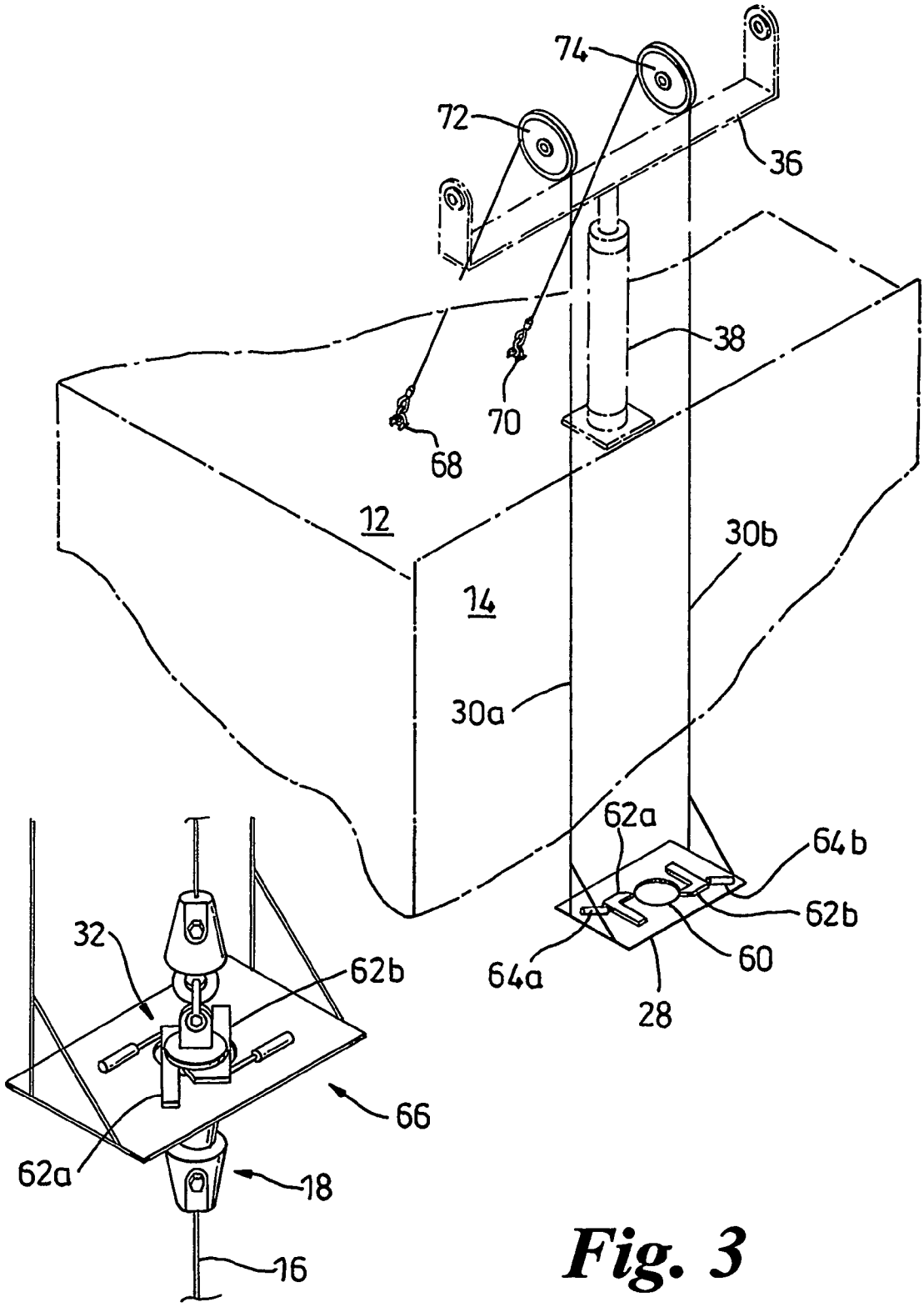
FIG. 3 shows in more detail the holding means including a hang-off platform in the apparatus of FIG. 1.

FIG. 3 shows in more detail the hang-off platform 28 and associated components. Again this comprises essentially a steel plate with an aperture 60 for passage of fibre rope 16 and joints 18. Latch 32 comprises first and second latch pieces 62*a* and 62*b* which can be moved by small rams 64*a* and 64*b* to close off the aperture as shown inset at 66. Wires 30*a* and 30*b* of fixed length support platform 28, being terminated at two further strong points 68 and 70 on deck 12. Wires 30*a* and 30*b* pass over to additional sheaves 72 and 74 respectively which are mounted on cross head 36 of heave compensator 34.

Fibre Rope System

Figure 4:
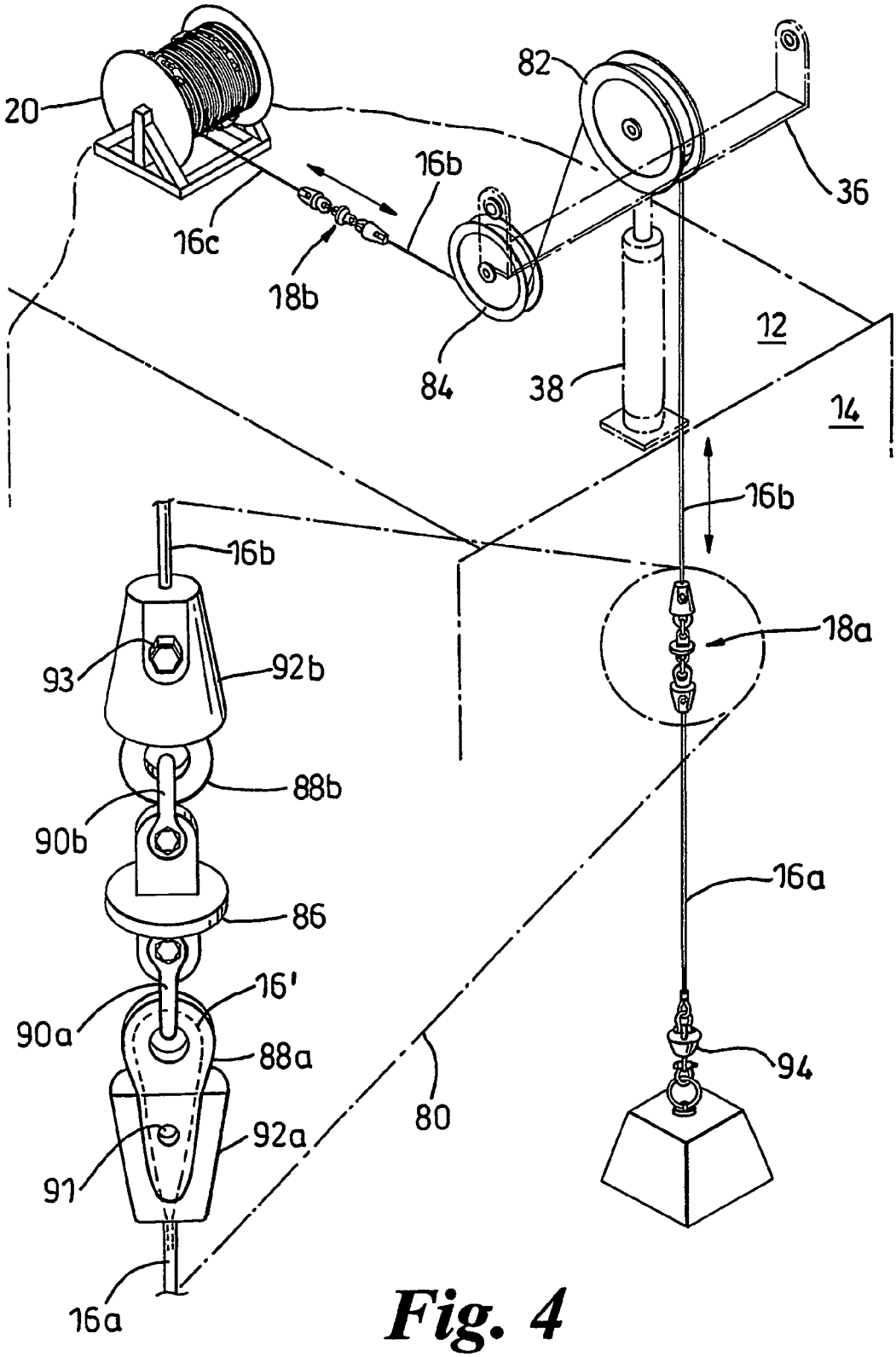
FIG. 4 shows a fibre rope system within the apparatus of FIG. 1, including enlarged detail of a joint between two rope sections.

FIG. 4 shows the fibre rope system in more detail, with enlarged detail of a typical joint 18 shown inset at 80. In this figure successive sections 16*a*, 16*b* and 16*c* of man-made fibre rope 16 are labelled separately. While these sections may in practice be 100 m or 300 m in length, they are shown shorter in the drawings for the purpose of illustration. The fibre rope used is far lighter, under water, than wire rope 24. If desired, and particularly for extreme depths, neutrally-buoyant rope may be specified, such that the load on the hoist system is effectively independent of depth.

In the condition shown, the bulk of rope 16 including joints 18 is wound on the drum of winch 20. Winch 20, serving as a rope store rather than a hoist, is driven to take up and pay out rope 16, though not to lift the weight of load 10. Further sheaves 82 and 84 are mounted respectively on heave compensator cross head 36 and deck 12 to pass the rope 16 from drum winch 20 over the side of the vessel, with heave compensation as required. The flanges of sheaves 82 and 84 are set wide enough to allow free passage of joints 18, it being understood that the portions 16*b* and 16*c* of fibre rope 16 are, in operation, not subject to the weight of load 10 to reduce fatigue in the fibre rope as it bends.

Figure 2:
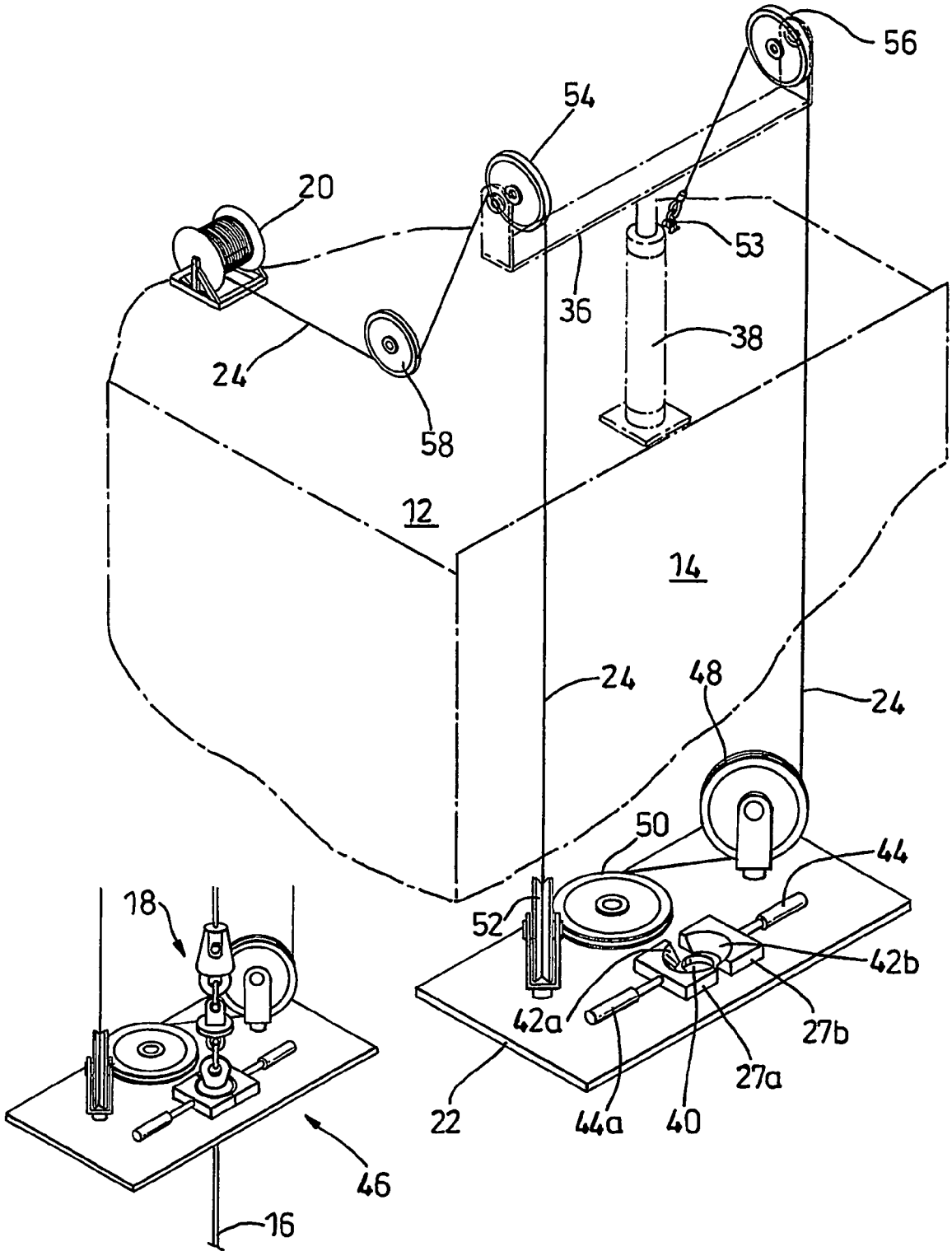
FIG. 2 shows in more detail a hoist system within the apparatus of FIG. 1.

Referring to the inset detail 80, each joint 18 in this embodiment comprises a symmetrical arrangement of components, permitting segmented rope 16 to be used without regard to the direction in which it has been wound on drum 20. At the centre of each joint 18 is a circular plate or collar 86, of a size suitable for engagement by the latched 32 of hang-off platform 28 (see detail 46 in FIG. 3). Rope segments 16*a* and 16*b* either side of the joint are terminated by respective thimbles 88*a* and 88*b*, which are connected to either side of collar 86 by shackles 90*a* and 90*b*. Attached rigidly to each thimble 88*a*, 88*b* is a respective part-conical stopper 92*a*, 92*b*. Each cone widens in the direction from the rope segment 16*a* to the terminating eye 88*a*. The lower stopper 92*a* is thereby adapted to be engaged by the part-conical surfaces 42*a* and 42*b* of the hoist platform jaws 27*a* and 27*b*, as seen in the detailed inset at 46 in FIG. 2.

Each stopper 92*a*, 92*b* is formed by two halves of steel, clamped to the respective thimble 88*a*, 88*b* by a bolt 93. The lower stopper 92*a* is shown with one half removed, to reveal the form of the thimble 88*a*. This comprises a solid metal piece, with a channel guiding the rope 16 along path 16' shown in broken lines. The rope doubles back and is spliced to itself in conventional fashion, the splice extending perhaps 3 or 4 m for security from the thimble. Unlike conventional thimbles, the thimbles 88*a* and 88*b* provide two distinct apertures in a solid body. The larger aperture allows passage of the shackle 90*a*, 90*b* which connects, via collar 86 and other parts, to the next rope segment. A smaller aperture 91 allows passage of the bolt 93 which, indirectly in this embodiment, allows connection of the rope segment 16*a* to the hoist platform 22. The body can be formed entirely by casting, or assembled from a split tube and other pieces.

Finally in relation to FIG. 4, it can be seen that a further cone stopper 94 is provided at the connection between the lowermost rope segment 16*a* and the load 10. Stopper 94 again is dimensioned and oriented to be engaged by the jaws 27*a* and 27*b* of hoist platform 22, as part of the lowering or lifting sequence, which will now be described in more detail.

Set-up for Lifting and Lowering

Summarising the configuration of the apparatus just described with reference to FIGS. 1 to 4, an ordinary, cylinder-based heave compensator 34 is provided, comprised of a hydraulic ram 38 with cross head 36 upon which sheaves are mounted, together with a winch system (26, 22) wherein the hoist medium is wire rope (24).

The wire 24 is taken from the winch 26 and passed through sheave 58 on the deck. It is then reeved through first sheave 54 on the heave compensator cross head and through a lowerable block in the form of platform 22 and sheaves 48, 50, 52. The standing part is then returned to the ship and reeved through the second sheave 56 on the heave compensator and subsequently made fast to strongpoint 53 on the deck. This provides a heave compensated double-fall lowering (and lifting) system.

As described above with reference to FIG. 3, wires 30*a* and 30*b* are led from two further strong points 68, 70 on the deck to hang-off platform 28 via the two additional sheaves 72, 74. The platform 28 is thus heave compensated at the same rate and in phase with the lowering system.

Man made fibre rope 16 (details in FIG. 4) is provided in lengths that are the same length (or shorter) as the travel of the lowering system hoist platform 22. These are terminated in eyes and joined together to form a continuous length suitable for the depth of the work and wound on to reel 20. The rope 16 is then reeved through the deck and cross head sheaves 84, 82.

Lowering Operation

With the complete apparatus constructed and prepared as just described, operation of the apparatus for lowering of a heavy load to the seabed proceeds as will now be described with reference to FIGS. 5 to 9. It will be appreciated that lifting operations can be performed by a simple reversal of the lowering process.

Figure 5:
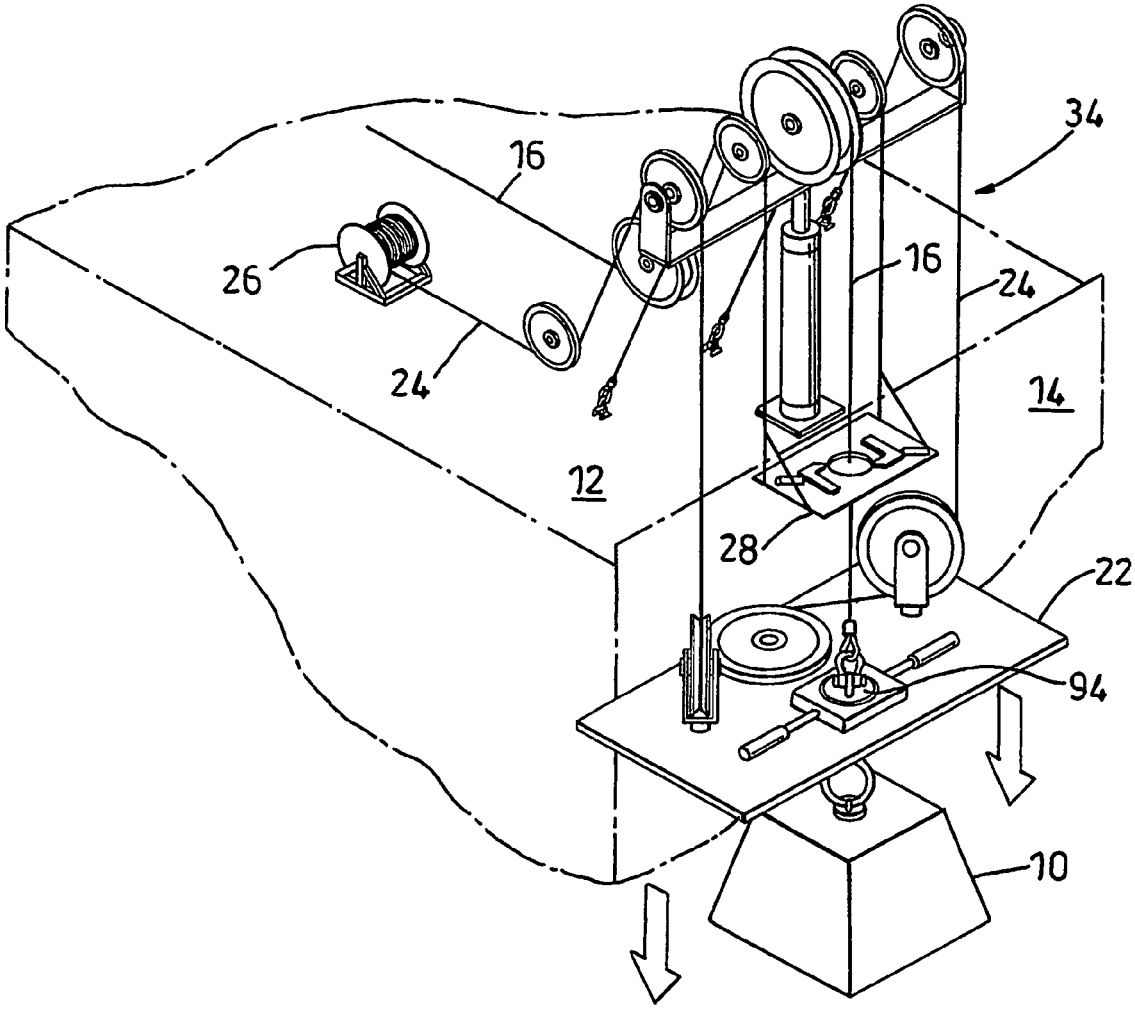
FIGS. 5, 6, 7, 8 and 9 illustrates successive stages in the operation of the apparatus, lowering a load to the seabed by a method according to the present invention.

FIG. 5 shows the apparatus in an initial condition. Load 10 has previously been passed overboard by a suitable crane (not shown), and suspended by stopper 94 in the jaws of hoist platform 22. Rope 16 has been passed through the aperture 60 in hang-off platform 28, and connected to stopper 94 by a shackle. The exact sequence of these operations can be varied to suit. Either platform 22 or 28 may be made openable to facilitate entry of the rope into the respective aperture 40, 60.

By operation of wire winch 26 paying out wire 24, the platform 22 and load 10 are lowered to the maximum depth of the lowering system with the rope 16 attached, thus drawing the rope 16 off the reel 20.

Figure 6:
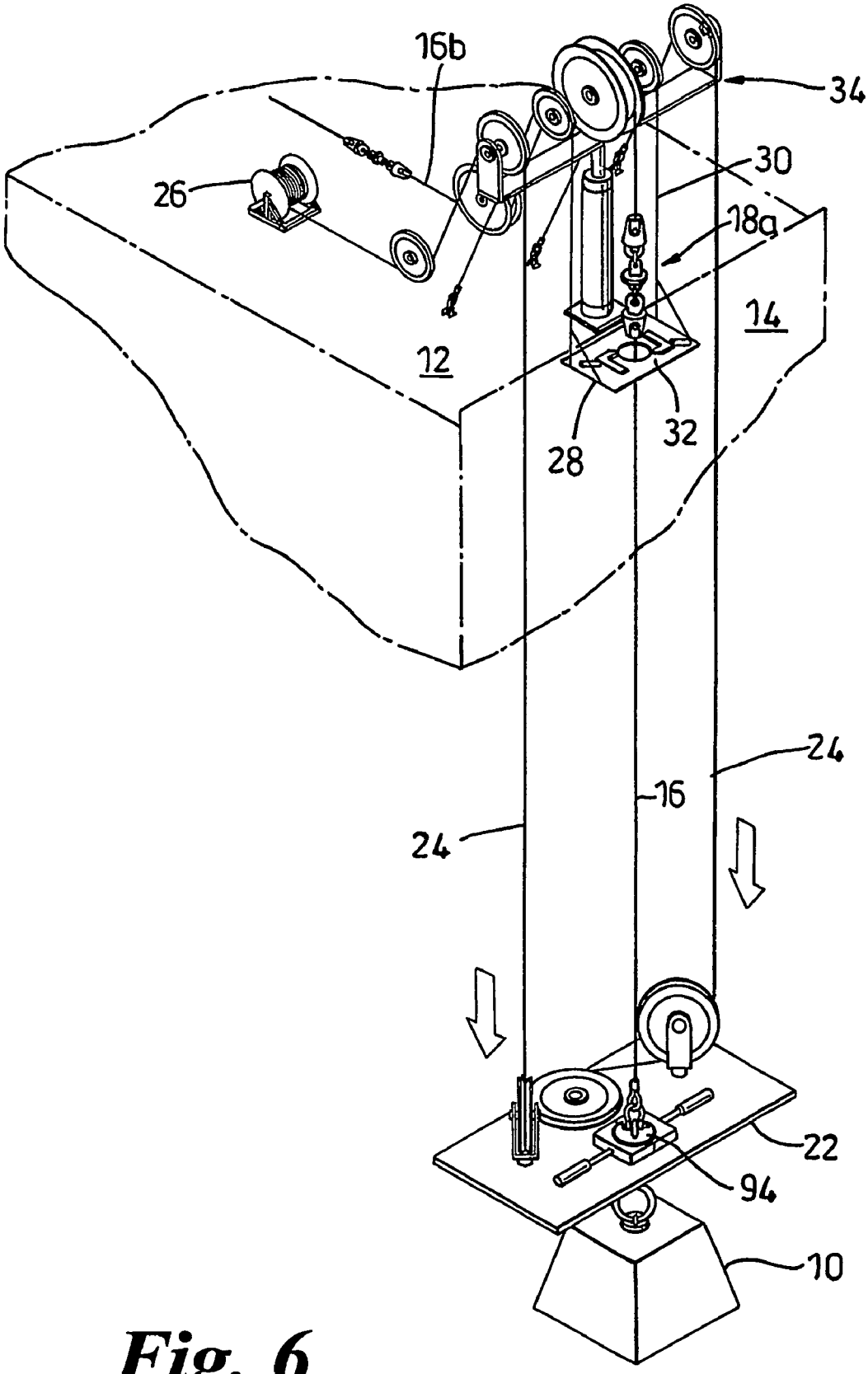

Reaching the position shown in FIG. 6, the first joint 18*a* in the rope 16 will now be at the hang-off platform 28 and a latch 32 is engaged which grips the collar of the joint.

Figure 7:
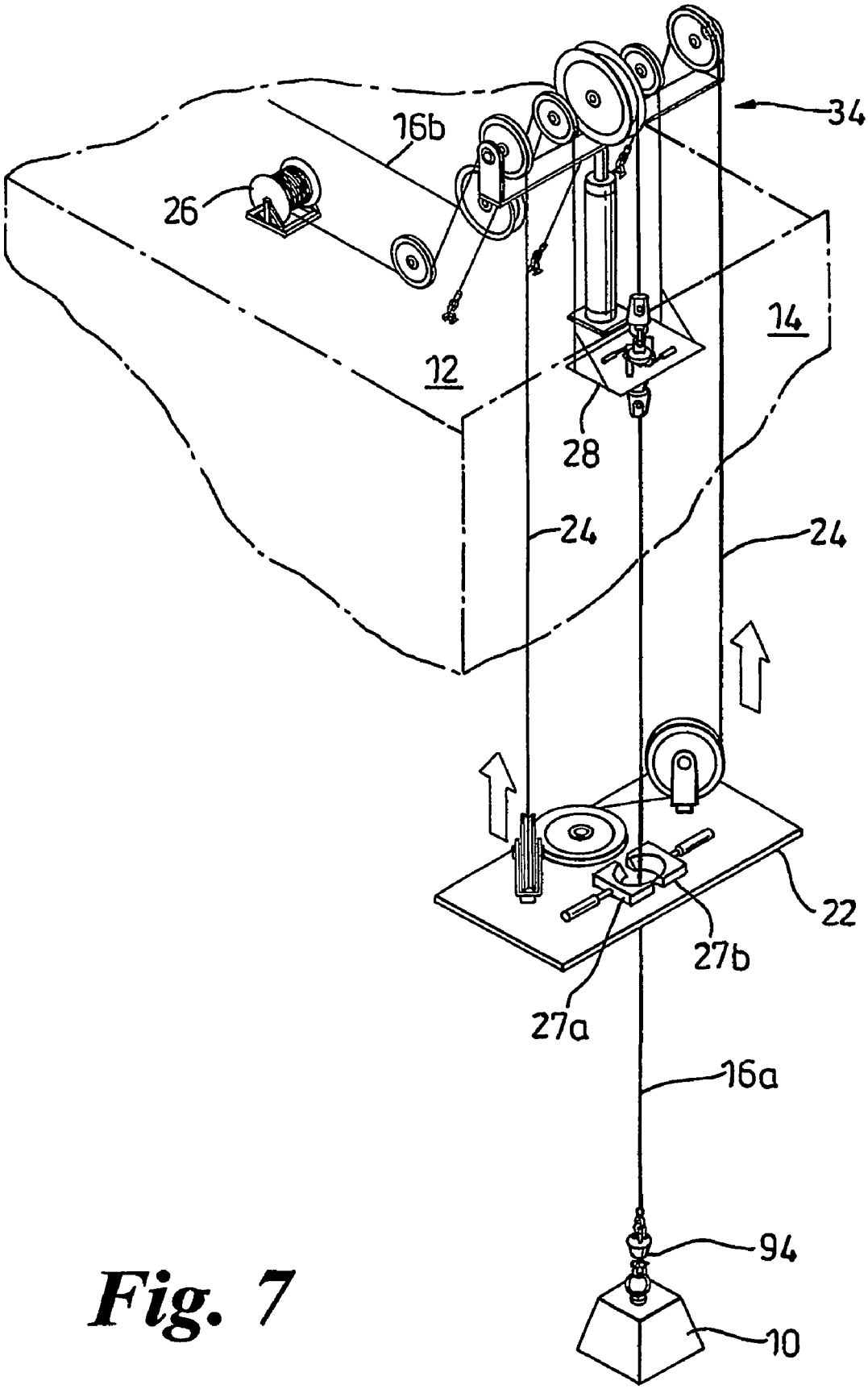
Figure 8:
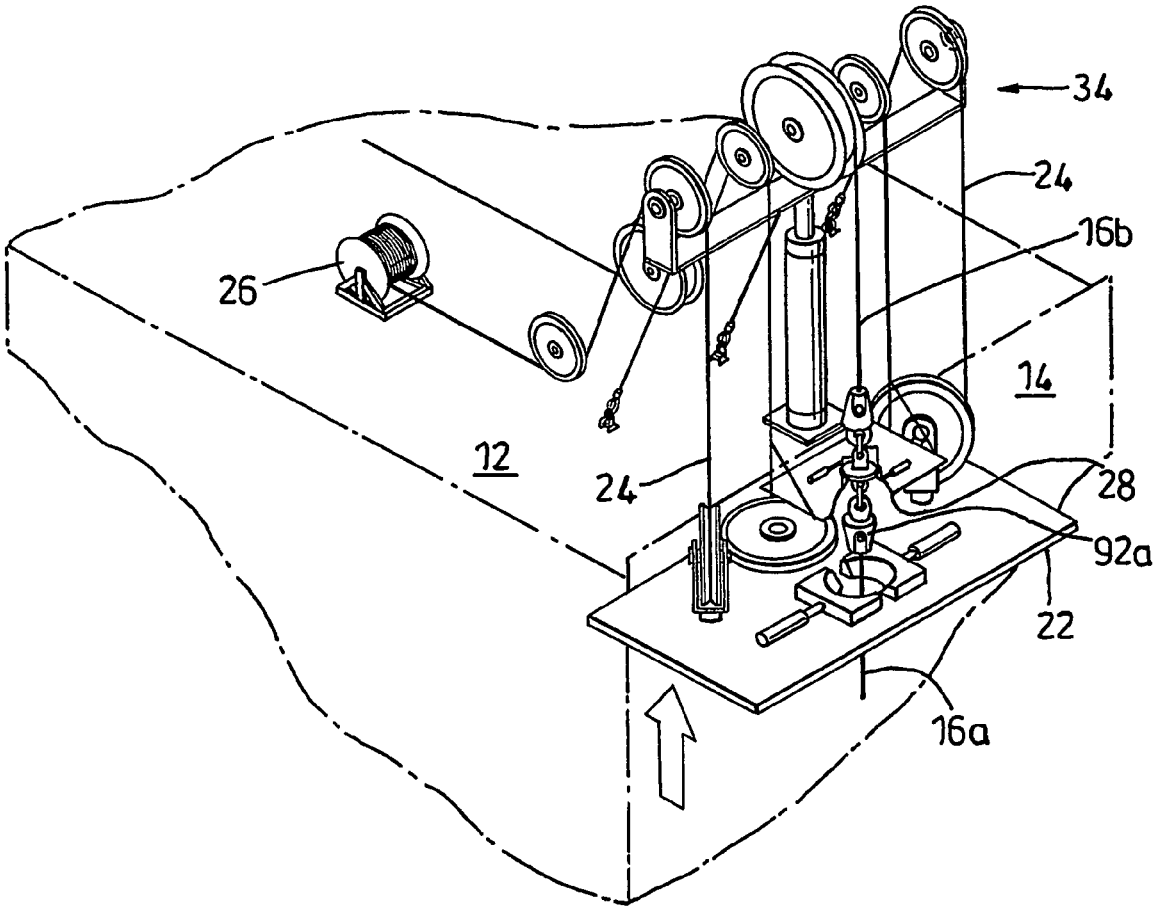
Figure 9:
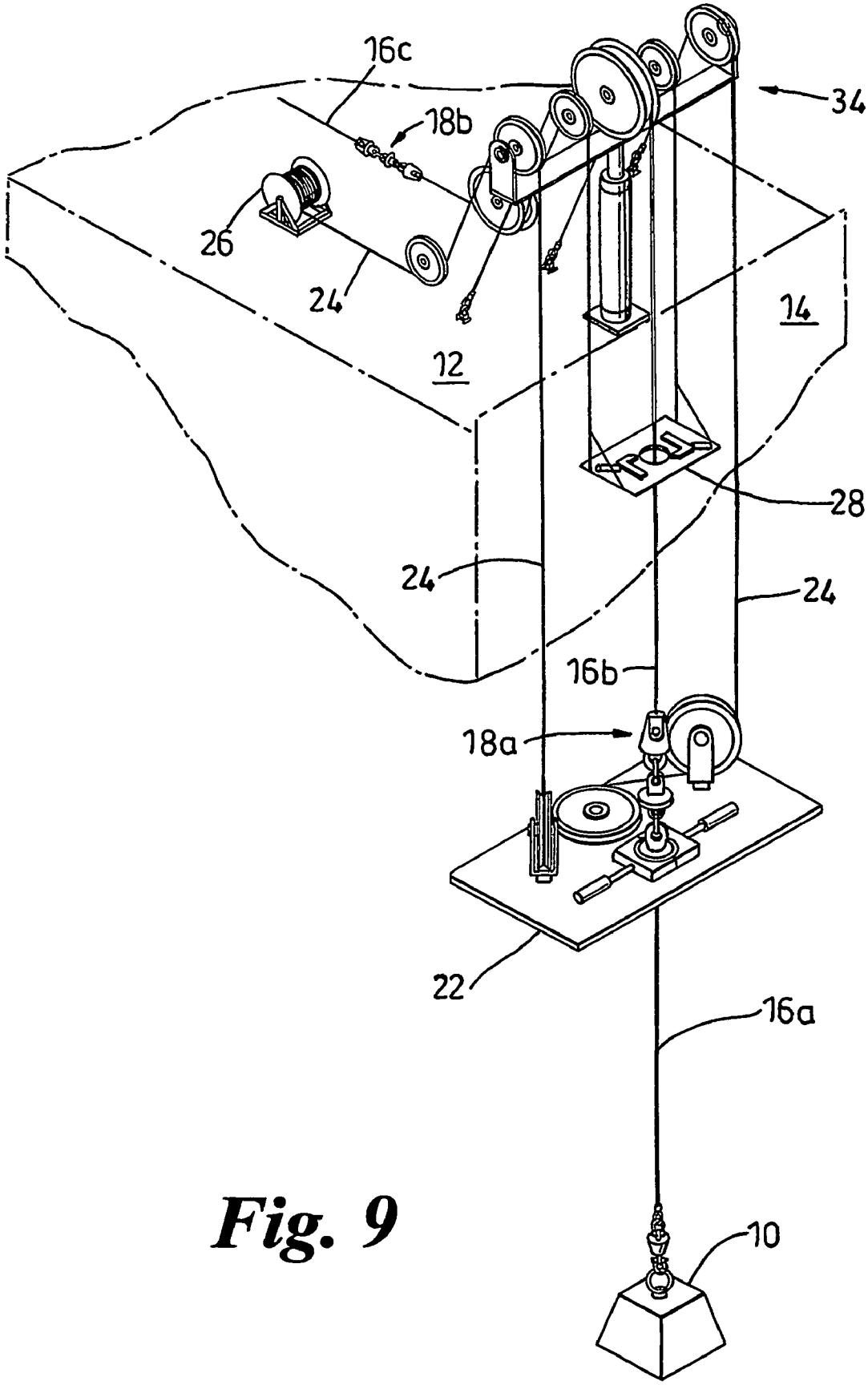

Referring now to FIG. 7, the load is now transferred to the rope 16 and hang-off platform 28, while the jaws 27*a*, 27*b* on the travelling block (platform 22) are released and recovered to the surface (FIG. 8). Once the hoist platform 22 is appropriately close beneath the hang-off platform 28, it connects with the lower stopper 92*a* of joint 18*a* in the rope 16 and takes the load again. The joint's collar 86 is released from the platform 22 and lowering may once again be undertaken.

In this manner the rope is never subjected to more than nominal load while being bend cycled through the winch, sheaves and especially the heave compensator. At the same time, all transfer operations are heave compensated.

Support for the process may be provided by a remotely operated vehicle (ROV) and/or divers, not shown. These may be stationed by the lowest position of the hoist platform 22, for example, where video observation and occasional intervention may be required to ensure reliable engagement and disengagement of the hoist from the rope stoppers 92*a* etc. Adequate observation may also or alternatively be provided by cameras mounted on the platform 22 and/or 28.

The method can be applied beneficially in oil & gas field development (sub-sea construction) in depths beyond 300 m. General lifting and lowering operations can also be envisaged in depths down to full oceanic depth, for example for Salvage, Oceanography, and Military purposes.

The invention claimed is:

1. A method of lowering equipment from a vessel to the seabed using man made fibre rope attached to the equipment and a winch employing wire rope, wherein the fibre rope is paid out in sections by repeated operation of the winch and wire rope.

2. A method as claimed in claim 1 wherein the fibre rope is continuous and is provided with eyes, stoppers or other attachment points at regular intervals.

3. A method as claimed in claim 1 wherein the fibre rope is continuous and comprises discrete sections terminated with eyes or other attachment points, connected together to form the required length.

4. A method as claimed in claim 3 wherein the connections between sections are made repeatedly as the fibre rope is paid out.

5. A method as claimed in claim 3 wherein the entire length is connected in advance and unreeled or reeled during operation.

6. A method as claimed in claim 3 wherein each fibre rope is terminated by looping around a thimble comprising a body with a peripheral channel for the rope, and two distinct openings, the first opening, receiving a connection, either directly or indirectly, to the next rope sections, the second opening receiving a connection, either directly or indirectly, to a hoist mechanism.

7. A method as claimed in claim 6 wherein the second opening receives a bolt which fixes a stopper to the thimble, the stopper being temporarily engaged by the hoist mechanism.

8. A method as claimed in claim 7 wherein the stopper comprises a part-conical member formed in two halves held together by the bolt.

9. A method as claimed in claim 7 wherein the fibre rope is provided between adjacent rope sections with stoppers engaged and released by a hoist mechanism openable by remote control to engage and release the fibre rope.

10. A method as claimed in claim 7 wherein the wire rope is arranged to lower a hoist mechanism, the hoist mechanism being operable by remote control to allow the mechanism to pass freely up and down the rope, and then to engage the rope by means of said stopper.

11. A method as claimed in claim 10 wherein the fibre rope is held at a holding means, while the wire rope is detached for connection to a next section.

12. A method as claimed in claim 11 wherein the holding means are arranged to engage an attachment point between adjacent rope sections but distinct from that engaged by the hoist platform.

13. A method as claimed in claim 12 wherein said holding means are pair of collars or other stoppers, spaced longitudinally to allow sufficient clearance between hoist mechanism and the holding means.

14. A method as claimed in claim 1 wherein the wire rope winch is heave compensated.

15. A method as claimed in claim 1 wherein the wire rope winch and holding means may both be heave-compensated, such that heave compensation can be maintained throughout the process of transferring the load from one to the other.

16. A method as claimed in claim 15 wherein the holding means and wire rope winch are heave compensated in parallel by a common heave compensator.

17. A method as claimed in claim 16 wherein said common heave compensator comprises a hydraulic ram.

18. A method as claimed in claim 1 wherein the winch and wire rope is arranged in a double fall arrangement, with the end of the wire rope fixed on board the vessel while a running block is lowered and raised, alternately connected to and disconnected from the fibre rope.

19. A method, as claimed in claim 1, wherein said method is achieved by an apparatus comprising a rope store, hoist means and holding means adapted for deployment from a sea-going vessel for implementing the method of raising or lowering.

20. A method, as claimed in claim 1, wherein the fibre rope includes a fibre rope assembly comprising plural rope sections and load-bearing stoppers connected between the sections.

21. A method of lifting equipment to a vessel from the seabed comprising using man-made fibre rope attached to the lifting equipment and a winch employing wire rope, wherein the fibre rope is drawn in, in sections by repeated operation of the winch and wire rope.

22. A method as claimed in claim 21 wherein the connections between sections are disconnected repeatedly as the fibre rope is drawn in.

23. A method as claimed in claim 21 wherein the wire rope is arranged lower a hoist mechanism, the hoist mechanism being operable by remote control to allow the mechanism to pass freely up and down the rope, and then to engage the rope by means of said stopper.

24. A method of lowering equipment from a vessel to the seabed comprising:

providing man made fibre rope attached to lifting equipment and a winch employing wire rope, wherein the fibre rope is continuous and is made in segments with a plurality of joints interconnecting adjacent segments; and paying the man made fibre rope out in sections by repeated operation of the winch and wire rope.

* * * * *